United States Patent [19]

Ross et al.

[11] 4,128,226

[45] Dec. 5, 1978

[54] EXTENSION LIGHT ASSEMBLY

[76] Inventors: Mervin L. Ross, 502 E. Burlington, Fairfield, Iowa 52556; Marvin W. Gittins, Rte. 1, Council Bluffs, Iowa 51501

[21] Appl. No.: 582,182

[22] Filed: May 30, 1975

[51] Int. Cl.[2] ..... F21V 15/00

[52] U.S. Cl. ..... 362/378; 362/396

[58] Field of Search ..... 240/52 R, 54 R, 54 A, 240/102 B

[56] References Cited

U.S. PATENT DOCUMENTS

| | | | |
|---|---|---|---|
| 1,680,723 | 8/1928 | Bloom | 240/54 A |
| 2,569,068 | 9/1951 | Maxwell | 240/54 A |
| 3,809,883 | 5/1974 | Goodwin | 240/54 A |
| 3,828,181 | 8/1974 | Goodwin | 240/54 A |

*Primary Examiner*—Robert K. Schaefer
*Assistant Examiner*—Vit W. Miska

[57] ABSTRACT

An extension light assembly of the kind having a socket and a protective shield for its lamp to which is added a positioning assembly comprising a stem having a hook at its outer end and a convex body on its inner end and means attached to the shield for movably but compressively holding the body whereby the position of the shield is selectively variable with respect to the stem for directing the light in a desired direction, the hook being constructed to prevent its rotation with respect to an object it is hooked on.

7 Claims, 7 Drawing Figures

EXTENSION LIGHT ASSEMBLY

FIELD OF THE INVENTION

This invention is in the field of extension light positioning assemblies of a kind attachable to an extension light and with respect to which the shield of the light is movably positioned for selectively directing the light.

DESCRIPTION OF THE PRIOR ART

No extension light positioning assemblies have been in massive and general use even though they would be very valuable for making it possible to direct the light.

Extension light assemblies have the bulb shielded on one side and so it is very important that the light be directed specifically at the place where the work is located. It is not sufficient for a workman to hold an extension light because he needs both hands to do the work.

It is important that an extension light positioning assembly have the characteristics of economy, durability, ease of attachment, and a multitude of possible positions which shield can assume with respect to a hook and stem of a positioning assembly, and it is an objective of this invention to provide these features.

A particular difficulty has been experienced with hooks when used on tools, such as extension lights. A common hook is made of bent wire and its inner surface is commonly a gradual arc. The result is that when such a hook is hooked on a readily available object, such objects being usually of much lesser diameter than the conventional hook, the extension light is not positioned with stability and, as its cord is moved, the extension light itself will tend to face at varying angles whereby it comes out of place and is no longer focused on the work. This is an exasperating situation for a workman since his light often comes out of place just at the time when his hands are both busy working on a spot in which he badly needs the light to see what he is doing.

It is, therefore, an object of this invention to provide a special hook so built that a hooked object will tend to be forced by the inclination of the hook toward an apex of the hook specially positioned to force the hooked object to engage a flat surface on one side of the hook whereby such engagement tends to prevent the object attached to the hook, such as an extension light assembly, from rotating undesirably, whereby the latter is held with stability.

SUMMARY OF THE INVENTION

An extension light assembly having a socket, a lamp, and a protective shield on one side of the lamp, and to which is added, by this invention, a positioning assembly comprising: a body, the body being disposed on the outer side of the shield, anchoring means anchored to the shield and compressively holding the body with the body movable with respect to the anchoring means whereby the position of the body can be adjusted but also whereby compression against the body will cause it to maintain itself in a pre-selected position, a hook, an elongated stem connecting the hook to the body, the hook and stem and body all being sufficiently rigid that when the hook is hooked on a supporting element, then the reflector will be caused to face in a pre-selected direction.

The extension light assembly described also has the further detail of economy of manufacture achieved by making the hook, the stem and the body all one piece of material which is preferably flat on two sides, and by providing a pressing member with an opening through which the stem extends and resilient means for anchoring the pressing member to the shield in a manner for compressing the body between the pressing member and the shield, whereby the same springs that are used for quick attachment of the positioning assembly to the shield also serve as an important part of the positioning asssembly operation itself for holding the shield in a desired position with respect to the stem.

A further object is to make use of the flat outer surface of the body for engaging the backside of the shield over a broader area than would be the case if it were in the shape of a sphere, whereby the shield and body are not worn away by constant abrasion.

Yet another object is to provide a hook with a special shape having a gnerally concave undersurface having an apex, the hook having two upwardly extending positioning sections connected by a connecting section at the apex, at least one of the positioning sections having a stabilizing surface provided with a shape either flat or with two engaging portions lying on a plane and being especially for engaging an element on which the hook is hung so as to prevent rotation of the hook with respect to the element, the two upwardly extending positioning sections of the hook inclining toward the apex in a manner tending to use gravity to force the element on which the hook is hung into engagement with the flat surface, whereby the hook engages the element with a stability for causing the shield to direct the light steadily in a pre-selected direction, and whereby a hook of this kind can be used for many purposes to support many kinds of objects, just one of the kinds of objects being tools, such as extension lights.

A further object is to provide a recess in the stem, preferably formed from the same material as the rest of the stem by a process of bending, and into which the cord can be hung to remove the weight of the cord from the end of the extension light handle, whereby the cord weight does not interfere with a positioning of the stem with respect to the shield which is resisted by the springs which hold the pressing member in place.

5 so as to reveal therebehind a flat surface of importance.

Figure 6:
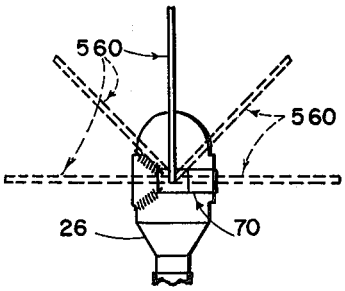

FIG. 6 is a rear elevation of the upper portion of the extension light assembly shown with the stem and hook in full-line position for vertical hanging and in many other dotted line positions extending to the right and left.

Figure 7:
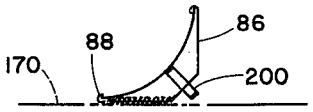

FIG. 7 is a diagrammatic view showing the shield in cross-section and with the remainder of the extension light assembly of this invention not shown, with the exception of a pressing member, a pressing member anchor disposed at an obtuse angle to the pressing member, and a pressing member anchoring spring assembly likewise disposed at an obtuse angle to the pressing member, whereby it can be seen that the obtuse angles mentioned can be utilized to position the shield at times when the anchoring members are rested on a flat surface.

DESCRIPTION OF THE PREFERRED EMBODIMENT

Figure 2:
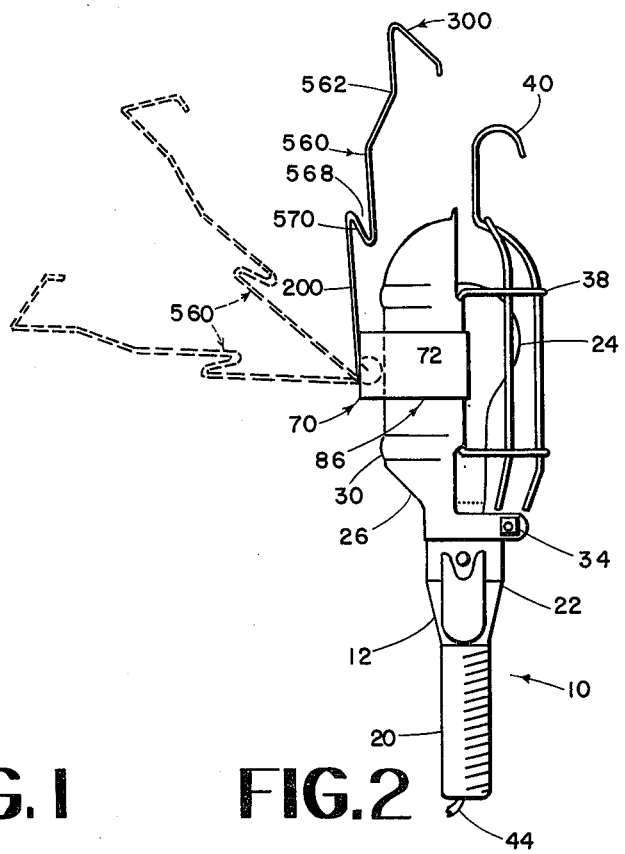
FIG. 2 is a right side elevation of the extension light assembly of FIG. 1, but also showing optional positions of the stem in dotted lines, other dotted lines showing hidden parts.

Referring to FIG. 2, an extension light assembly of this invention is generally indicated at 10 and comprises an extension light unit generally indicated at 12 comprising a handle 20, a socket 22 receiving a bulb 24, which latter is protected by a protective shield 26 having a reflector portion 30 which is conventionally made of sheet metal and which is attached to the socket 22 by a bolt 34, the reflector 30 being concave on its forward side in a conventional manner for receiving the bulb 24 and being convex on its rearward side and covering approximately half of the bulb, as the extension light unit is seen in side elevation in FIG. 2, the forward side of the bulb being protected by a wire cage 38 forming part of the shield 26 and attached to the reflector 30 and having at its upper end a shield hook 40.

All of the above-described parts are conventional and common in the extension light units of the kind called "trouble lights", and operated at car-battery current coming through a extension cord 44 only a part of which is shown in FIG. 2. The above-described elements are also common for use with 110-volt electricity in other extension lights, for which also the positioning assembly of this invention can be used.

Figure 3:
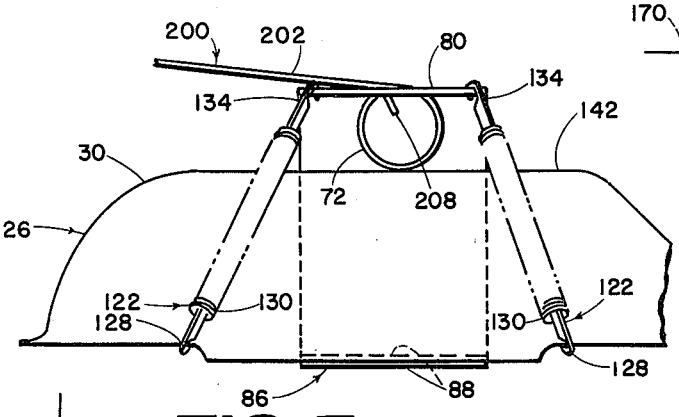
FIG. 3 is a detail view of the shield of the assembly as it would be seen from the left side in FIG. 1, but rotated 90° so that the forward side of the reflector faces downwardly.

In accordance with this invention, a positioning assembly generally indicated at 70 is provided and has a body 72, seen only in dotted lines in FIG. 2 and much better seen in full lines in FIG. 3.

The body 72 is compressed between a pressing member 80 spaced from the rearward side of the shield 26, and the rearward side of the reflector 30 of the shield itself.

A first anchor 86 is attached to the right-hand side of the pressing member 80 and extends generally forwardly and to the right therefrom at an obtuse angle thereto. The first anchor 86 is formed preferably of one piece of material with the pressing member 80 and has a forward end formed into a hook 88, seen in FIGS. 3 and 7, which latter wraps around the right-hand forward edge 89 of the reflector 30. Since the anchor 86 and its hook 88 are of one piece with the pressing member 80, and all are rigid, an effective anchor is provided.

A left-hand anchor assembly is generally indicated at 122 in FIG. 3 and comprises a pair of forward hooks 128 hooked around the forward edge of the left-hand side of the reflector 30 and a pair of rearward hooks 134 hooked into openings 136 in the left hand side of the pressing plate 80, the hooks 128 being vertically spaced apart and the hooks 134 being vertically spaced apart, and a pair of springs 130 being disposed, one connecting the upper one of the hooks 128 with the upper one of the hooks 134, and the other connecting the lower one of the hooks 128 with lower one of the hooks 134. The springs 130 are tension springs, whereby the left-hand anchoring assembly 122 firmly draws the left-hand side of the pressing plate 80 forwardly so as to press the body 72 against the rearward side of the reflector 30.

A positioning assembly is generally indicated at 200 in FIG. 3 and comprises the body 72, a stem generally indicated at 560 in FIG. 2 which has a lower straight portion 202, seen in FIG. 3, attached to and forming a one-piece part of the body 72, the one-piece of material being a piece that is flat on at least one and preferably two sides, whereby the outer side of the body 72 is generally approximately of cylindrical shape terminating in an inwardly turned position 208 with the straight portion 202 extending tangentially to the cylindrical configuration of the outer side of the body 72. The lower end of the stem 560 can also be considered to have a body portion or body 72.

The upper end of the positioning assembly 560 is a hook generally indicated at 300 in FIG. 2, the hook 300 being disposed normally as seen in FIG. 2 directly above the shield 30 and the stem 200 inclining from the hook rearwardly beginning at a point 562, seen in FIG. 2, and then downwardly and being bent substantially back upon itself rearwardly to form a notch 568 to receive the cord 44, as later described, and an offset portion 570 of the stem 200 inclining upwardly and rearwardly to meet the lower straight portion 202 of the stem 200 so as to form a notch 568, which latter opens upwardly and rearwardly when parts are in the most common position shown in FIG. 2.

Referring to FIG. 7, a flat surface 170, external of the entire extension light assembly, is shown in dotted lines and rested thereon is one of the springs 130 of the left-hand anchoring assembly 122 for illustrating that resting the light assembly in this way can cause its reflector to face upwardly and to one side giving further optional positioning, since the springs 130 incline at an obtuse angle with respect to the pressing plate 80 forwardly and outwardly therefrom. FIG. 7 is actually diagrammatic and abbreviated since the end of the handle 20, not shown therein, would also rest on the surface 170, but the view of FIG. 7 serves to illustrate the point and also that the right-hand anchoring member 86 is at an obtuse angle which could be placed against the surface 170 for directing the reflector so as to face in another direction. Further, the reflector can be rested upon its rearward side wherein the disposition of the pressing plate 80 extending from right to left will position parts for directing the reflector so as face upwardly, as not shown.

Figure 1:
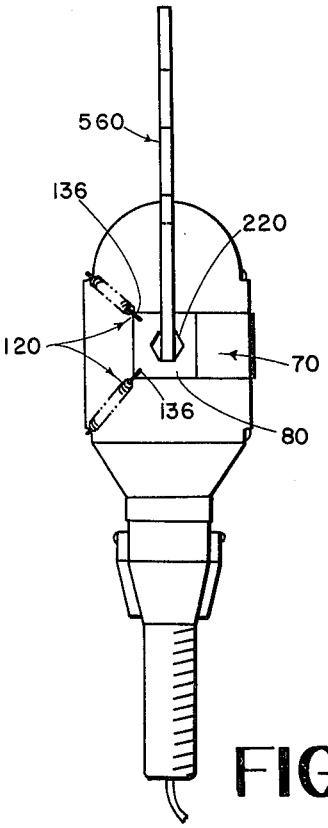
FIG. 1 is a rear elevation of an extension light assembly of this invention with most of the cord thereof broken away and shown in a position for hanging vertically downward.

Referring to FIG. 1, it can be seen that the opening 220 through the pressing plate 80 is from forward to rearward and that it is preferably hexagonal in shape. As seen in FIG. 6, a positioner 560 can be swung to the right and left from its position shown in full lines and as seen in FIG. 6 in dotted lines, and also, the positioner 560 can be caused to extend at various angles with respect to the vertical, as seen in FIG. 2, so as to generally incline outwardly at various angles rearwardly from the reflector 30, giving many varying positions of direction of reflector-facing at times when the extension light assembly is suspended on the positioner hook 300, and also at times when the extension light assembly is simply rested upon some flat surface with the positioner 560 engaging the flat surface so as to support the reflector 30 so as to face in a certain selected, precise direction, all as can be imagined from looking at FIGS. 2 and 6.

Figure 4:
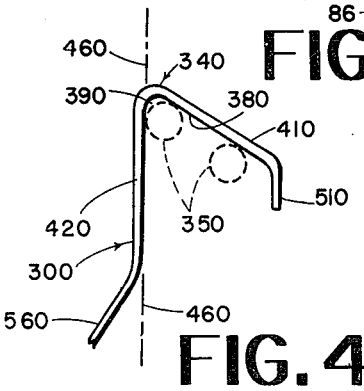
FIG. 4 is a detail showing the upper end of the stem and hook and showing in a lower dotted line the position of a rod on which the hook might be hooked before the hook slides down on the rod, whereby the upper dotted line shows the position of the rod after the hook has settled completely down on it.
Figure 5:
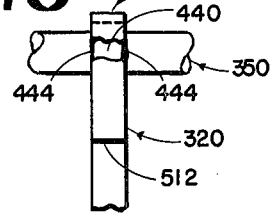
FIG. 5 shows the parts of FIG. 4 as they would be seen from the right in FIG. 4, but showing the hook in a position assumed after it has moved completely downwardly onto the rod, which latter is shown in dotted lines, a portion of the right-hand side of the hook, as it would be seen in FIG. 4, is shown broken away in FIG.

Referring now to FIGS. 4 and 5, a stabilizing interconnection assembly is there generally indicated at 340 and comprises a first part formed by the hook 300 and a second part formed by an object on which the hook is hooked which can be rod, such object or external supporting element or rod being shown at 350.

The first part or hook 300 is disposed at least partly above the rod or second part 350, with one of the parts, the part 350, supporting the other one of the parts, the hook 300, against the pull of gravity.

It can be said that the hook 300 is one of the two parts of the interconnection assembly 340, and that the hook 300 has a generally concave-receiving portion 380, seen in FIG. 4, having an apex 390 at is upper end.

The hook 300 has two upwardly extending positioning sections 410 and 420 connected by a connecting section 424 at the apex 390.

In a sense, the second part or external element or rod 350 of the interconnection assembly 340 can also be called a hook-received part thereof 350 to assist claiming terminology.

At least one of the positioning sections 410 and 420 is seen, as illustrated by the positioning section 420, to have a stabilizing surface 440 which can be preferably flat and which is provided with two engaging portion 444 which lie on a plane 460 which faces the opposite upwardly extending positioning section 410.

The hook-received part or element or rod 350 of the interconnection assembly 340 is disposed in engagement with the two engaging portions 444 for stabilizing the position of the parts 300 and 350 with respect to each other.

The parts 300 and 350 are free of areas definable as being disposed in engagement with each other and which can also be defined as disposed between the engaging portions 444, whereby the engaging portions can indeed engage the other part 350 for stabilizing positioning of the parts with respect to each other.

The two positioning sections 410 and 420 are inclinedly disposed with respect to each other and both extend upwardly on their undersides as the interconnection assembly 340 is seen in right-side and left-side elevations, the former being a mirror duplicate that can be imagined.

The positioning sections 410 and 420 incline toward each other at those opposite ends thereof which are closest to the apex 340.

The interconnection assembly 340 has right and left hand sides in the same sense that its hook 300 opens downwardly and forwardly.

The plane 460 extends upwardly between the left and right hand sides of the interconnection assembly 340.

The stabilizing surface 440 has its engaging portions 444 disposed to the left and right of each other respectively, whereby the hook-received part 350 is urged by gravity toward the apex 390, in one sense, but in another sense, the hook 300 is urged by gravity downwardly across the hook-received part or rod 350 so that the apex 390 becomes close to the rod 350, whereby the hook-received part or rod 350 becomes disposed in engagment with the two engaging portions 444, which latter cooperate with each other and with the other upwardly extending positioning section 410 to resist a horizontal twisting of the hook-received part or rod 350 with respect to the hook, but in a more usual sense of use, to resist a horizontal twisting of the hook and hook-received parts 300 and 350 with respect to each other.

In a sense, the stem 560 and all other parts of the light assembly described herein can be considered to form a tool which is suspended from the hook 300, whereby, in a broad sense, the positioning hook 300 of this invention has many uses, one of them being generally to support a tool.

In another broad sense, the stabilizing interconnection assembly 340 comprising the first part defined by the hook 300 and the second part defined by the hook-received part or rod 350, has many uses in many fields.

As best seen in FIGS. 4 and 5, the positioning sections 410 and 420 of the hook 340 are each elongated and can be understood to have a maximum width of cross-section, such as would be seen from left to right across the positioning section 410 seen in FIG. 5 or 420 which would be right behind it, such cross-section being taken transversely to the length of the respective positioning section 410 or 420, which latter maximum widths are substantially the same along the majority of the lengths of the positioning sections 410 and 420.

And so all parts of the extension light assembly which are suspended from the positioning section 420, per FIG. 4, can be considered to broadly be an object of utility suspended from or attached to one of the parts, namely, positioning section 420, of a hook and element assembly 800, defined by the element 350 and the hook 300.

Referring now to FIG. 2, it will be seen that the notch 568 can receive a portion of the cord 44, which latter portion is close to the handle 20, so as to support the weight of the cord 44 so that, if it is very long, it will not tend to pull down on the handle 20 so as to tend to pull the reflector 30 out of position with respect to the hook 300. More particularly, if the cord portion between the handle 20 and the notch 568 (when the stem 560 is in the lower dotted line position of FIG. 2, such as might be the case if the shield 30 were to be suspended so as to face directly downwardly from the hook 300) then the cord portion between the handle 20 and the notch 568 can be caused to be at such a minimum as to tend to pull the stem 560 even further toward the handle 20 than the position it would assume with the pressing plate 80 in the FIG. 2 position generally parallel to the length of the handle and shield 26, whereby the springs 130 can be stretched for allowing the stem 560 to be further disposed toward the handle slightly to give still more optional positioning of the reflector 30 with respect to the hook 300.

As thus described, it is believed that an extremely versatile extension light unit positioning assembly is provided herewith, and one which is of low cost and easily attached.

As can be seen in FIGS. 1 and 2, it can be seen that the opposed wall portions of the notch 568 have opposed parts which are spaced apart less than half of the minimum horizontal width of the downwardly extending handle 20.

It can be seen that the extension light of this invention, together with all portions of its stem 560 which are below its hook 300, can be taken as a total and considered to be an object of utility, which latter is suspended from the hook 300 on the element 350 of FIG. 5, thus illustrating the broad uses of the hook and element combination seen in FIGS. 4 and 5.

We claim:

1. An extension light assembly comprising an extension light unit having an upwardly extending socket for receiving a bulb, a handle extending downwardly from said socket, an extension cord electrically connected to said socket and extending out of the lower end of said handle, a protective shield on the rearward side of and mostly above said socket, an electric light bulb in said socket, an elongated substantially rigid stem having a hook at its upper end, mean attaching the lower end of said stem to that side of said shield which is opposite said bulb in an adjustable manner such that said stem can be placed in various positions extending respectively at various angles from said shield and so that when said hook is hooked onto an object the angle at which said stem is disposed with respect to said shield will cause said shield to face in various respective directions for focusing light from said bulb and to be held by said attachment mean firmly so as to maintain the selected angular position of said shield with respect to said stem, said means attaching said stem to said shield comprising a stem positioning assembly comprising a stem pressing means on the rearward side of said shield, means mounting said stem pressing means on said shield comprising spring means attached to said shield and to said pressing means and resiliently urging said pressing means towards said shield, said means attaching the lower end of said stem to said shield further comprising the lower end of said stem having a body portion disposed between said pressing means and said shield and said body portion being pressed against said shield by said stem pressing means, said stem pressing means having an opening therethrough through which said stem extends but through which said body portion of said stem cannot pass, the yielding of said spring means permitting said stem body portion to move with respect to said shield.

2. The extension light assembly of claim 1 having said body portion provided with an outer surface having at least a portion thereof substantially of the shape of a portion of a cylinder for engaging the back side of said shield slidably.

3. The extension light assembly of claim 1 in which said hook and said stem and the body portion of said stem are all formed of a single piece of material which has two opposite sides disposed in parallelism as seen in cross section.

4. An extension light assembly comprising an extension light unit having an upwardly extending socket for receiving a bulb, a handle extending downwardly from said socket, an extension cord electrically connected to said socket and extending out of the lower end of said handle, a protective shield on the rearward side of and mostly above said socket, an electric light bulb in said socket, an elongated substantially rigid stem having a hook at its upper end, means attaching the lower end of said stem to that side of said shield which is opposite said bulb in an adjustable manner such that said stem can be placed in various positions extending respectively at various angles from said shield and so that when said hook is hooked onto an object the angle at which said stem is disposed with respect to said shield will cause said shield to face in various respective directions for focusing light from said bulb and to be held by said attachment means firmly so as to maintain the selected angular position of said shield with respect to said stem, said means attaching the lower end of said stem to said shield comprising a stem positioning assembly comprising a stem pressing means on the rearward side of said shield, means mounting said stem pressing means on said shield comprising spring means having at least one spring attachment hook which latter is hooked around an edge of said shield, said hook being on one end of said spring means and the other end of said spring means being attached to said pressing member and said spring means being in tension and urging said pressing member and said spring means being in tension and urging said pressing member toward said shield, said attachment hook being easily detached from said shield when desired.

5. An extension light assembly for use with an extension light unit having an upwardly extending socket for receiving a bulb, a handle extending downwardly from said socket, an extension cord electrically connected to said socket and extending out of the lower end of said handle, a protective shield on the rearward side of and mostly above said socket, an electric light bulb in said socket, said extension light assembly comprising: an elongated substantially rigid stem having a hook at its upper end, means for attaching the lower end of said stem to that side of said shield which is opposite said bulb in an adjustable manner such that said stem can be placed in various positions extending respectively at various angles from said shield and so that when said hook is hooked onto an object the angle at which said stem is disposed with respect to said shield will cause said shield to face in various respective directions for focusing light from said bulb, said stem attaching means being adopted to cooperate with said shield and said stem so as to hold said stem firmly so as to maintain the selected angular position of said shield with respect to said stem, said means attaching said stem to said shield comprising a stem positioning assembly comprising a stem pressing means adopted to be positioned on the rearward side of said shield, means for mounting said stem pressing means on said shield comprising spring means for attachment to said shield and to said pressing means and for resiliently urging said pressing means towards said shield, said means for attaching the lower end of said stem to said shield further comprising the lower end of said stem having a body portion for disposal between said pressing means and said shield whereby said body portion can be pressed against said shield by said stem pressing means, said stem pressing means having an opening therethrough through which said stem extends but through which said body portion of said stem cannot pass, the yielding of said spring means being for permitting said stem body portion to move with respect to said shield.

6. An extension light assembly for use with an extension light unit having an upwardly extending socket for receiving a bulb, a handle extending downwardly from said socket, an extension cord electrically connected to said socket and extending out of the lower end of said handle, a protective shield on the rearward side of and mostly above said socket, an electric light bulb in said socket, said extension light assembly comprising: an elongated substantially rigid stem having a hook at its upper end, means for attaching the lower end of said stem to that side of said shield which is opposite said bulb in an adjustable manner such that said stem can be placed in various positions extending respectively at various angles from said shield and so that when said hook is hooked onto an object the angle at which said stem is disposed with respect to said shield will cause said shield to face in various respective directions for focusing light from said bulb, said stem attaching means being adopted to cooperate with said shield stem so as to hold said stem firmly so as to maintain the selected angular position of said shield with respect to said stem, having said body portion provided with an outer surface having at least a portion thereof substantially of the shape of a portion of a cylinder for engaging the back side of said shield slidably.

7. An extension light assembly for use with an extension light unit having an upwardly extending socket for receiving a bulb, a handle extending downwardly from said socket, an extension cord electrically connected to said socket and extending out of the lower end of said handle, a protective shield on the rearward side of and mostly above said socket, an electric light bulb in said socket, said extension light assembly comprising: an elongated substantially rigid stem having a hook at its upper end, means for attaching the lower end of said stem to that side of said shield which is opposite said bulb in an adjustable manner such that said stem can be placed in various positions extending respectively at various angles from said shield and so that when said hook is hooked onto an object the angle at which said stem is disposed with respect to said shield will cause said shield to face in various respective directions for focusing light from said bulb, said stem attaching means being adopted to cooperate with said shield and said stem so as to hold said stem firmly so as to maintain the selected angular position of said shield with respect to said stem, having said hook and said stem and the body portion of said stem are all formed of a single piece of material which has two opposite sides disposed in parallelism as seen in cross section.

* * * * *